US007305728B2

(12) United States Patent
Schlieps

(10) Patent No.: US 7,305,728 B2
(45) Date of Patent: Dec. 11, 2007

(54) PLUMBERS SUPPORT PILLOW

(76) Inventor: Mark A. Schlieps, 11230 29th. Ave. SW., Seattle, WA (US) 98146

( * ) Notice: Subject to any disclaimer, the term of this patent is extended or adjusted under 35 U.S.C. 154(b) by 174 days.

(21) Appl. No.: 10/904,041

(22) Filed: Oct. 20, 2004

(65) Prior Publication Data

US 2006/0080780 A1 Apr. 20, 2006

(51) Int. Cl.
*A47C 16/00* (2006.01)

(52) U.S. Cl. ..... 5/657; 5/655.9; 5/905; 5/922

(58) Field of Classification Search ..... 5/655.9, 5/657, 640, 656, 653, 652, 648, 636, 634, 5/633, 922, 905, 632, 631, 635, 630
See application file for complete search history.

(56) References Cited

U.S. PATENT DOCUMENTS

| | | | | | |
|---|---|---|---|---|---|
| 2,612,645 | A | * | 10/1952 | Boland | 5/633 |
| 2,618,790 | A | * | 11/1952 | Ritchey | 5/636 |
| 3,677,569 | A | | 7/1972 | Larson | 280/32.6 |
| 3,775,785 | A | * | 12/1973 | Mittendorf | 5/640 |
| 4,171,549 | A | * | 10/1979 | Morrell et al. | 5/632 |
| 4,441,221 | A | * | 4/1984 | Enste et al. | 5/657 |
| 4,506,396 | A | * | 3/1985 | Ritchie et al. | 5/631 |
| 4,712,258 | A | * | 12/1987 | Eves | 5/652 |
| 4,777,678 | A | * | 10/1988 | Moore | 5/657 |
| 4,802,249 | A | * | 2/1989 | Bills | 5/632 |
| 4,972,533 | A | * | 11/1990 | Brown | 5/636 |
| 4,987,625 | A | | 1/1991 | Edelson | 5/431 |
| 5,014,373 | A | * | 5/1991 | Dobine | 5/636 |
| 5,029,350 | A | | 7/1991 | Edelson | 5/431 |
| D342,638 | S | * | 12/1993 | Harland | D6/601 |
| 5,400,449 | A | * | 3/1995 | Satto | 5/631 |
| 5,432,967 | A | | 7/1995 | Raftery | 5/633 |
| 5,448,790 | A | * | 9/1995 | Saro et al. | 5/657 |
| 5,733,011 | A | | 3/1998 | Young et al. | 297/423.11 |
| 6,154,904 | A | * | 12/2000 | Ehredt | 5/640 |
| 6,292,964 | B1 | * | 9/2001 | Rose et al. | 5/630 |
| 6,298,508 | B1 | * | 10/2001 | McCloskey | 5/632 |
| 6,360,387 | B1 | * | 3/2002 | Everhart | 5/630 |
| 6,578,217 | B1 | | 6/2003 | Roberson | 5/632 |
| 6,691,356 | B1 | * | 2/2004 | Coma | 5/657 |
| 6,783,175 | B1 | * | 8/2004 | Henderson | 5/653 |
| 7,020,918 | B1 | * | 4/2006 | Tinsley | 5/632 |
| 7,036,162 | B1 | * | 5/2006 | Gatten | 5/421 |
| 2003/0097713 | A1 | * | 5/2003 | Kinchen et al. | 5/652 |
| 2006/0075563 | A1 | * | 4/2006 | Bartner et al. | 5/905 |

* cited by examiner

*Primary Examiner*—M. Safavi
(74) *Attorney, Agent, or Firm*—Charles J. Rupnick

(57) ABSTRACT

Two identical support cushions are flexibly joined to provide ergonomic support to a person having to perform physical activities in a supine position, often in confined spaces, such as a plumber lying on his back under a sink inside a cabinet with the lower part of the body being positioned on the room floor and the upper part of the body being positioned on the raised floor of the cabinet. The lightweight and rugged support cushions can be easily configured into a valise-like rectangular shape for easy carrying utilizing integrated handles. In addition, a plurality of lamps is enclosed within the support cushion, the lamps comprising light diffusing lenses and the lamps being spatially aligned to provide illumination with minimum shadow creation of the space in front of the supported person, such as a plumber working under a sink in a cabinet.

3 Claims, 7 Drawing Sheets

PLUMBERS SUPPORT PILLOW

BACKGROUND OF THE INVENTION

People employed in various crafts, especially plumbers, often have to work much of the time in a supine position with the worker's body distributed over uneven surfaces in a confined space. Most typical of such a work environment is a plumber working under a sink in a kitchen or in a bathroom cabinet. The cabinet floor is typically elevated over the room floor by the height of the space under the cabinet, known to those skilled in the art of kitchen cabinets as kickspace. A plumber working in a cabinet has the upper part of the body, that is shoulders and above, positioned under a sink inside a cabinet and the feet positioned on the room floor.

Body measurements of plumbers and cabinet dimensions vary significantly. The relationship of the plumber's body measurements to the cabinet dimensions will determine where will the plumber's buttocks be positioned. The closer the plumber's buttocks are to the edge of the cabinet floor, the higher the level of discomfort the plumber will experience. If the plumber's body measurements and the cabinet size are such that the position of the plumber's buttocks is on the room floor just in front of the cabinet, or if the plumber must maintain the buttocks in the air above the floor by exerting a strain on the plumber's muscular system, then the plumber is risking a potentially serious spinal injury.

Other source of strain on the plumber's spine is from the necessity of having to keep the plumber's head at a position that is elevated above the cabinet floor.

A person working in a confined space, such as under a sink in a cabinet has to use both hands for the task at hand. Support of the worker's body in a supine position with the body extended over the uneven or irregular surfaces often requires the worker to use one of the hands for additional body support. The use of one hand for support complicates the work task and increases chances of worker's injury. Additionally, work in confined spaces, such as a plumber working in a cabinet, requires the workspace to be well illuminated, preferably without shadows. Having to carry lamps, and finding means to attach one or more lamps in a position providing proper illumination, further complicates the worker's task.

The "Foldable Crawler", U.S. Pat. No. 3,677,569 by Larson, provides a crawler to facilitate working in a supine position under a kitchen sink. The "Foldable Crawler" supports the plumber on a hard surface in a substantially horizontal position only. The "Plumber's Support Pillow" arrangement supports the plumber in an ergonomically more correct canted position and on a softer resilient surface and provides means to illuminate the workspace in a manner that minimizes the shadow creation by the illuminating means.

Other support cushions taught by prior art, such as the "Portable Multiple Section Adjustable Posture Contour Care Bed" taught by Bills in U.S. Pat. No. 4,802,249, and the "Adjustable Personal Support Apparatus" taught by Edelson in U.S. Pat. No. 4,987,625, and the "Cross-legged Seating Apparatus" taught by Edelson in U.S. Pat. No. 5,029,350, and the "Multiple Position Support cushion" taught by Raftery in U.S. Pat. No. 5,432,967, and the "Support cushion and Method for Accommodating Multiple Body Positions" by Roberson in U.S. Pat. No. 6,578,217, provide personal body support on single plane horizontal surfaces and do not teach the means to support a plumber working in a supine position over raised surface, such as in a cabinet under a sink.

The "Multiple Position Tool Caddy Seat" taught by Young in U.S. Pat. No. 5,733,011, describes a tool caddy that can also be used to support a worker laying on his stomach.

The need thus clearly exists for a device that provides lightweight ergonomic support, and workspace illumination, for persons working in a supine position over a raised surface in a confined space.

BRIEF SUMMARY OF THE INVENTION

The object of this invention is a system of flexibly joinable support cushions for ergonomic support of a person working in a supine position, on uneven surfaces in confined spaces. The preferred embodiment of the invention is optimized for plumbers typically working in a supine position spread over two vertically displaced surfaces, with the upper part of the plumber's body, usually shoulders and above, positioned under a sink inside a cabinet, the floor of which is typically raised approximately four inches above the room floor, and the feet positioned on the room floor.

The flexibly joinable support cushions provide an ergonomic support for the plumber's body, the head, and the shoulders, and the buttocks, enabling all body supports to be positioned on a single canted essentially flat plane, thus eliminating the potential of an injury that can be caused by strain on the spine typical of work in a supine position over uneven vertically displaced surfaces and eliminating most of the discomfort typical with this type of activity.

The optional use of the multiple lamps built into the support cushion further contributes to the safety and efficiency of plumber's work by illuminating the workspace above the plumber. Lamps housed in the support cushion provide diffused light beams for illumination of the workspace. Diffused light from multiple light beams minimizes the creation of shadows which are created by an object or by the plumber's hand intersecting a single light beam, such as from a portable lamp or from a flashlight.

DETAILED DESCRIPTION OF THE INVENTION

The invention relates to identical substantially wedge-like six-sided polyhedron shaped support cushions that are capable of being non-permanently flexibly joined and arranged in several configurations for the purpose of providing ergonomic support to a person having to perform manual activities, mostly while the person's body is in a supine position. The support cushions may be used to support a person on a single surface or the support cushions may be configured to support a person's body over a plurality of staircase-like vertically and horizontally separated planes. The support cushions may further comprise a plurality of light sources embedded in the support cushions to provide a substantially diffused illumination of the space in front of the person while supported by the support cushions in supine position in small substantially enclosed spaces.

A plumber working in a cabinet has the upper part of the body, that is shoulders and above, positioned under a sink inside a cabinet and the feet positioned on the room floor. The cabinet floor is typically elevated over the room floor by the height of the space under the cabinet, known to those skilled in the art of kitchen, cabinets as kickspace. The height differences and the elevated edge of the cabinet floor create pressure on the plumber's spine and cause potentially injurious strain of many muscle groups while the plumber is in a supine position working in the cabinet.

Figure 4:
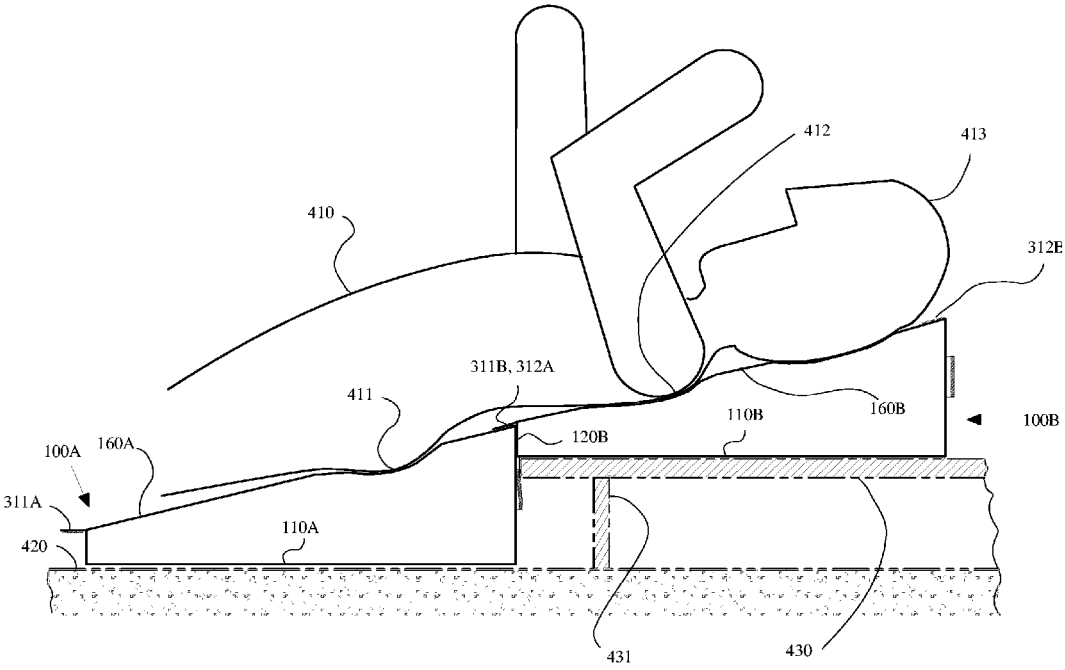
FIG. 4 is a perspective view depicting the use of Velcro tape fastener to join two support cushions.

The preferred embodiment, as schematically illustrated on FIG. 4, comprises a first support cushion 100A and an identical second support cushion 100B arranged to support a plumber 410 without pain and discomfort while in a substantially supine positions with the plumber's lower body being positioned on a room floor and the plumber's upper body being positioned on a raised floor inside a cabinet. The first support cushion 100A is positioned with it's base surface 110A on the room floor 420, cross-section of which is shown for reference with phantom line outlines. The second support cushion 100B is positioned with it's base surface 110B on the cabinet floor 430, cross-section of which is shown for reference with phantom line outlines. The first and the second support cushions 100A, 100B are flexibly and non-permanently joined with a Velcro fastener consisting of a first part 312A which is attached to the top surface of the first support cushion 160A and of a complementary part 311B which is limply attached to the edge of the support cushion created by the front surface 120B and the top surface 160B of the second support cushion 100B. The top surface 160A of the first support cushion 100A and the top surface 160B of the second support cushion 100B thus joined and positioned form a substantially straight platform, wherein the platform forms an oblique angle with the floors 420 and 430. The platform formed by the two support cushions is elevated over the edge of the cabinet floor 430 which is typically raised above the room floor 420 by a cabinet base 431. The plumber 410 is comfortably supported in an ergonomically correct position above the two floors by the canted platform as depicted in FIG. 4, wherein the plumber's buttocks 411 are supported by the top surface 160A of the first support cushion, and the plumber's shoulders 412 and the plumber's head 413 are supported by the top surface of the second support cushion 160B.

Figure 1:
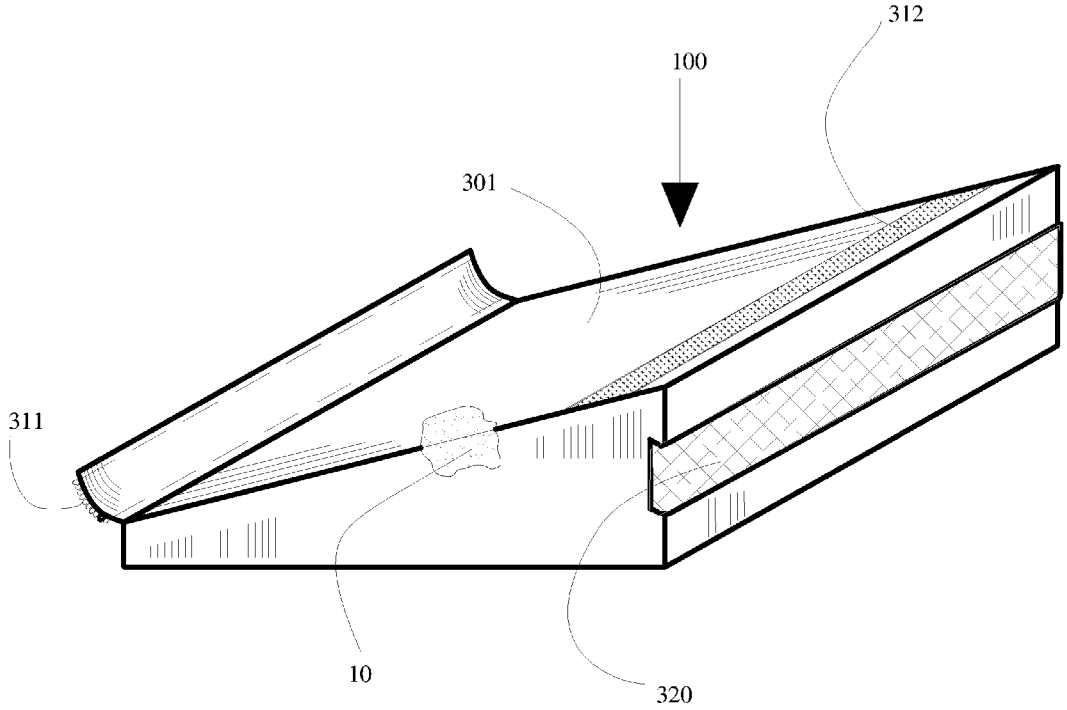
FIG. 1 is a perspective view of a single support cushion.

The construction of the support cushions 100 is shown in FIG. 1. The resilient core 10 is covered with cover material 301. The characteristics of the cover material include durability, and mildew resistance, and capability of being waterproof, such as provided by the a cover material such as 330 Denier Cordura, which is commercially available.

Further referring to FIG. 1, a strip of webbing 312 approximately 2 inches in width is attached to the support cushion near each of the two edges formed by the back surface with the side surfaces. The length of the strip is approximately 10 percent larger than the length of the back surface, thus creating a pliable handle for carrying.

Figure 2:
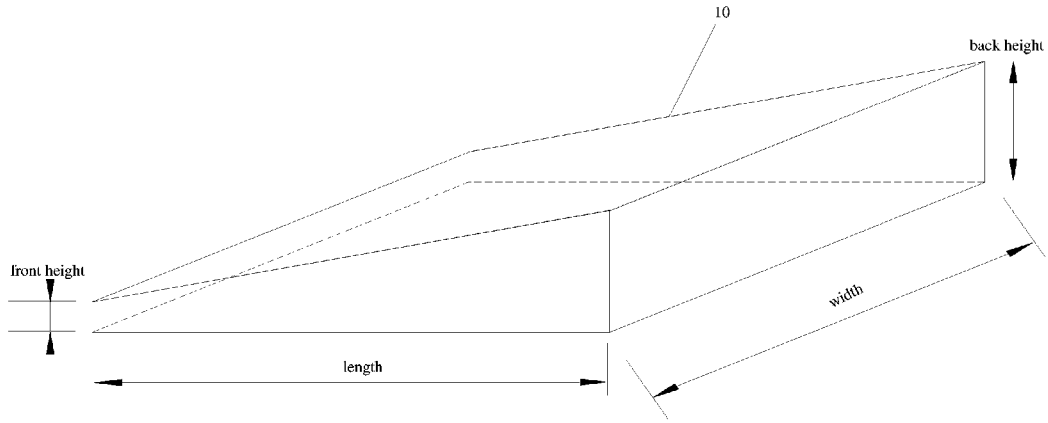
FIG. 2 is a perspective view of a support cushion core and the definition of the dimensions defining the support cushion shape.

The shape of the support cushion results from the shape of the six-sided polyhedron core 10 shown on FIG. 2. The core 10 of the preferred embodiment has: a length of approximately eighteen inches, and a width of approximately thirteen-and-a-half inches, and a front height of approximately one-and-a-half inches, and a back height of approximately six inches. The afore shown dimensions have been found to be suitable for plumber's work under sinks. The core of the preferred embodiment is made of lightweight resilient material, such as open-cell polyurethane foam. Other materials capable of being resiliently compressible may be substituted. The importance of resiliency and compressibility is required for the comfortable support of the plumber as shown on FIG. 4, wherein the buttocks 411 and the shoulders 412 and the head 413 create a conforming concave compressions in the supporting support cushions further reducing the strain on the plumber's spine while supporting the plumber in the supine position. The density of the core material will vary with the user's size and the core dimensions will vary with the environment for which the support cushions will be made.

Further referring to FIG. 1, the means for flexibly joining the support cushions to each other is provided by a commercially available sew-on tape hook and loop type fabric fastener. The first part of the fastener 312 is a Velcro tape attached to the top surface of the support cushion parallel with and near the edge created by the top surface with the back surface. The complementary component of the fastener is formed by attaching the complementary Velcro fastener 311 to a strip of cover material wherein the assembly of the cover material strip is attached to the edge of the support cushion created by the top surface of the support cushion with the front surface of the support cushion.

Figure 3:
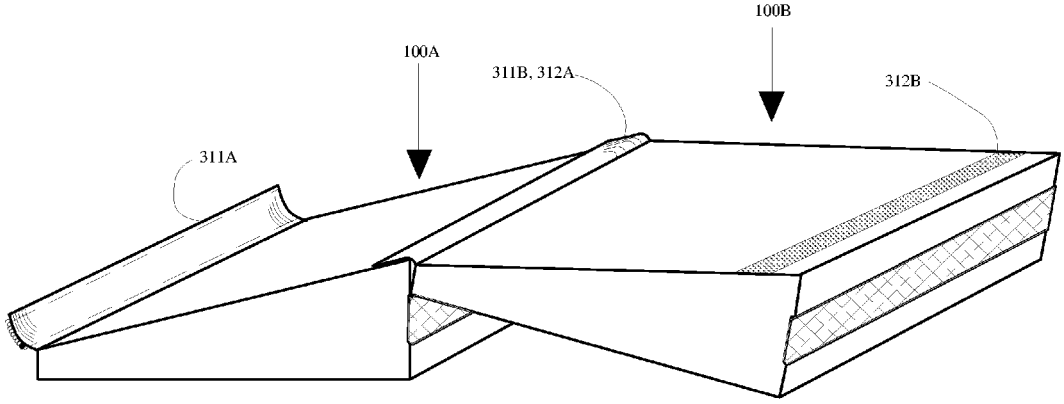
FIG. 3 schematically depicts the ergonomic support of a person in a supine position over two vertically separated surfaces, as provided by the two identical flexibly joined support cushions, wherein a canted, essentially flat support platform is created by these cushions.

The details of joining the two identical support cushions 100A and 100B to form a two-support cushion arrangement are depicted on FIG. 3, wherein the non-permanent flexible joining is achieved by pressing together the complementary parts of the Velcro fasteners 311B and 312A.

Figure 5:
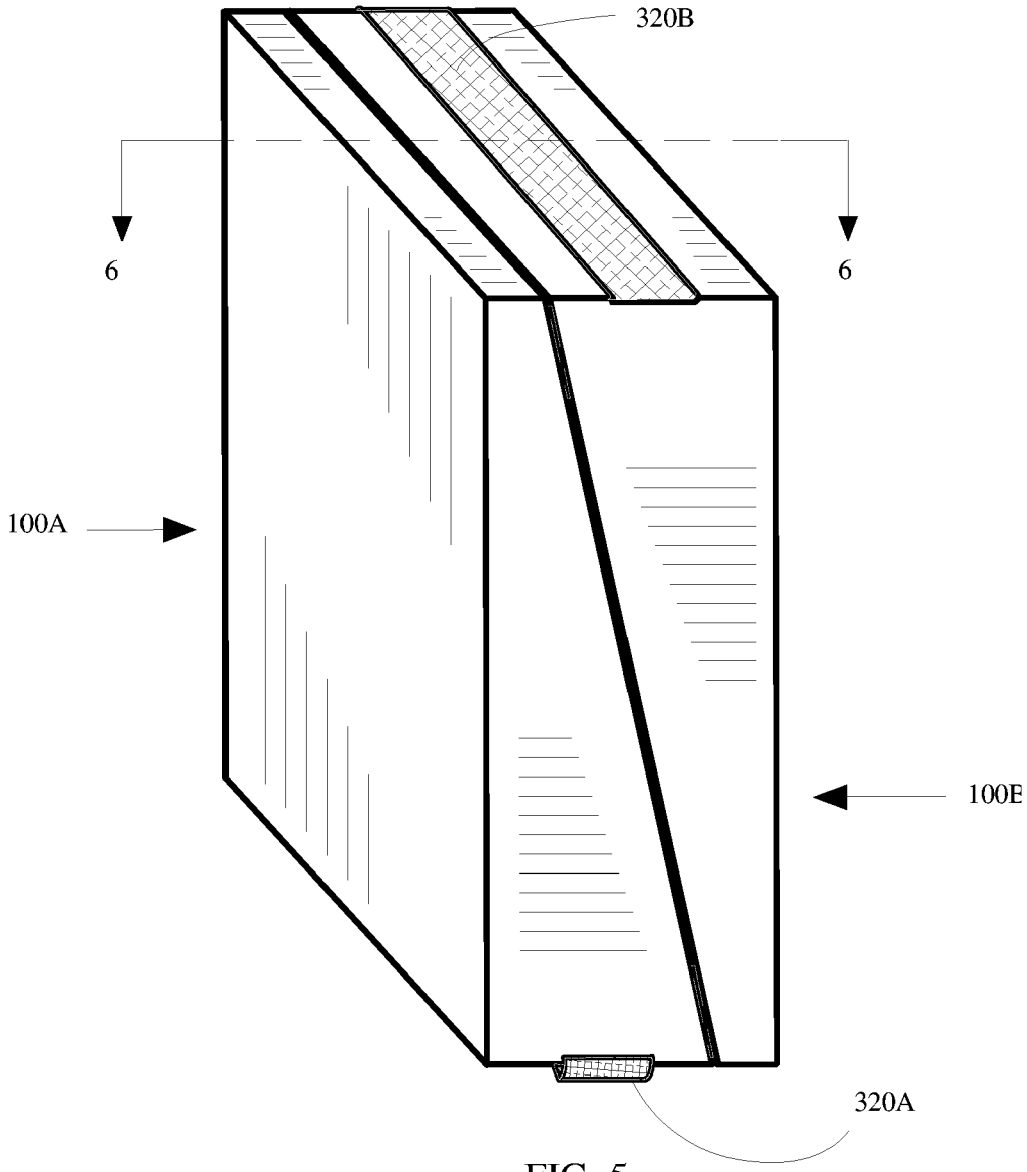
FIG. 5 is a perspective view of valise-like arrangement of the two identical support cushions for carrying.
Figure 6:
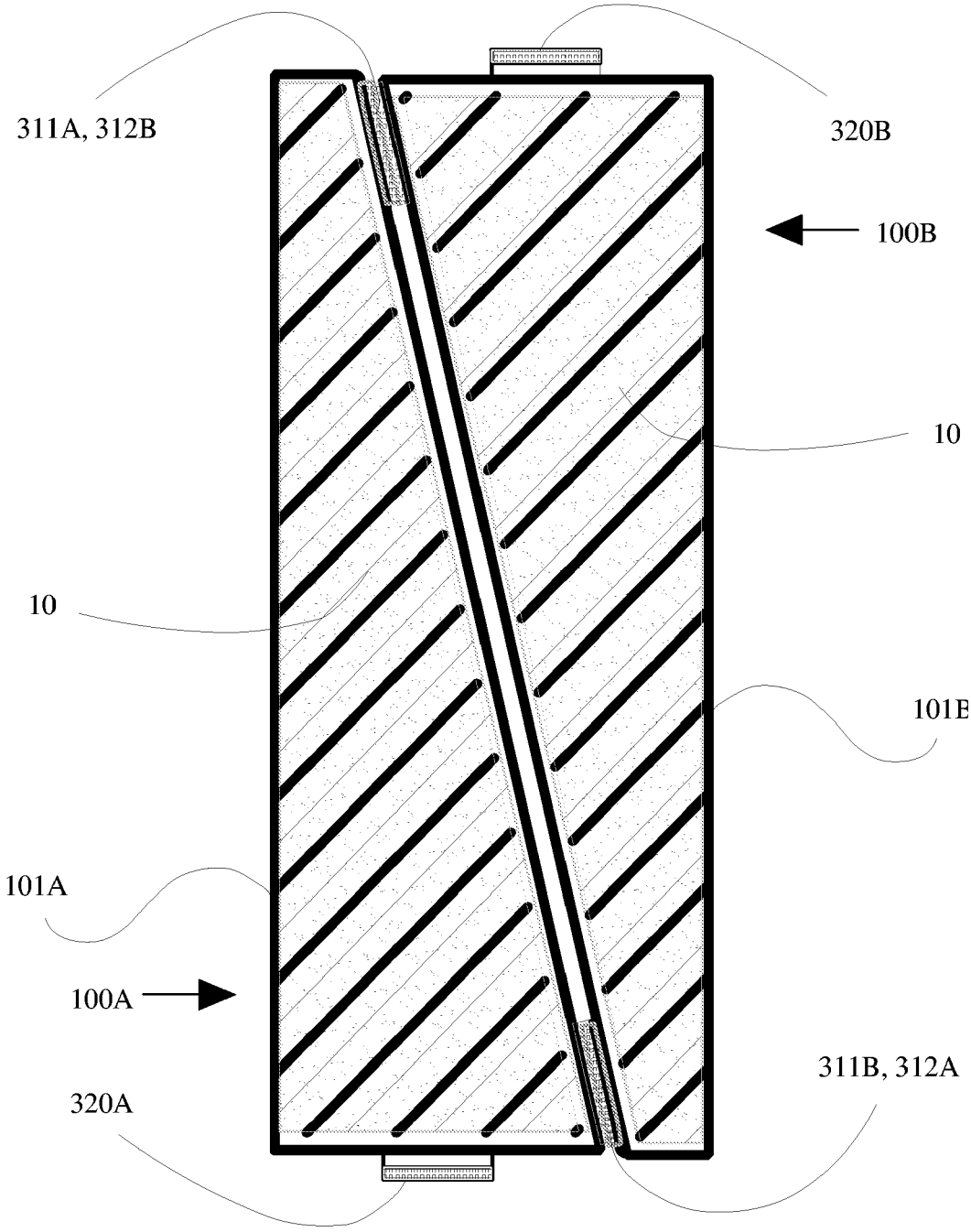
FIG. 6 is a cross-section through the support cushions of FIG. 5, depicting the two identical support cushions in the valise-like arrangement.

Referring to FIG. 5, an arrangement into a valise-like assembly formed by two support cushions is depicted. The two support cushions 100A and 100B are arranged facing each other with their respective top surfaces with the front surface of one of the support cushions located next to the back surface of the other support cushion. The Velcro fastener of each support cushion is attached to the complementary fastener of the other support cushion to form a substantially solid six-sided prism, wherein each surface of the prism is a rectangle and opposite sides are congruent. The joined first and second part of the Velcro fasteners 311 and 312 are shown on FIG. 6, the cross-section 6-6 of the valise-like assembly shown on FIG. 5. Referring to FIG. 6, there are all remaining parts of the support cushion shown, the core 10, the cover 601, and the handles 320A and 320B.

Figure 7:
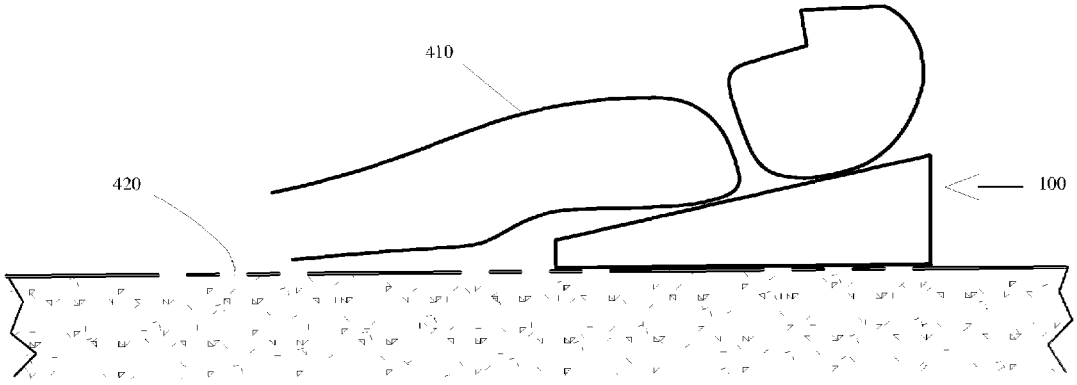
FIG. 7 schematically depicts the use of a single support cushion to support a person's upper body on a level floor.

An alternate embodiment utilizing a single support cushion is shown on FIG. 7, wherein the upper body and head of the person 410 is supported on a single substantially level floor surface 420 by a single support cushion 100.

Figure 8:
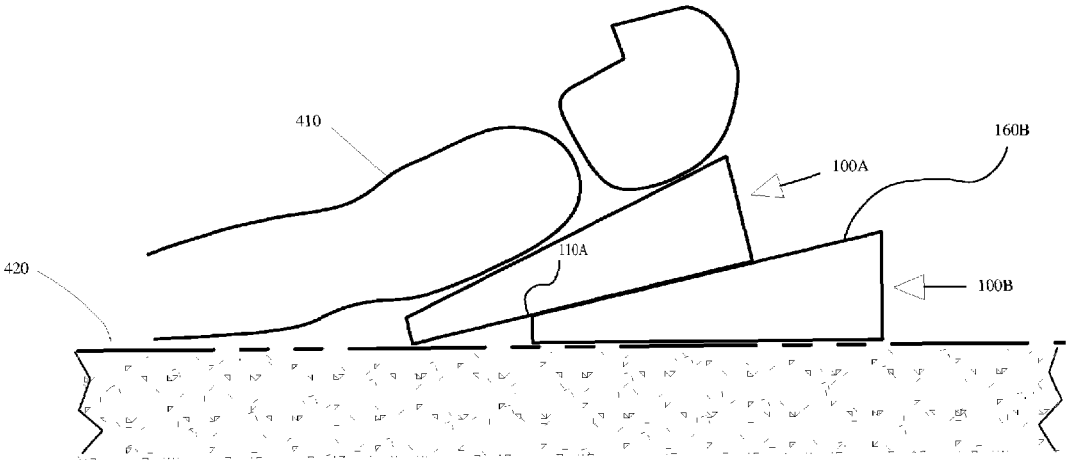
FIG. 8 schematically depicts the use of two identical disconnected support cushions to provide support of a person's upper body on a level floor with increased upper body elevation.

Another alternate embodiment of a two-support cushion arrangement is shown on FIG. 8, wherein the upper body and head of the person 410 is supported by the first support cushion 100A, the base 110A of which is positioned on the top surface 160B of the second support cushion 100B and wherein the second support cushion 100B is positioned on a single substantially level floor surface 420. The first support cushion 100A is not attached to the second support cushion 100B and can be slideably located on the top surface 160B of the support cushion 100B as needed to vary the elevation of the support surface.

Figure 9:
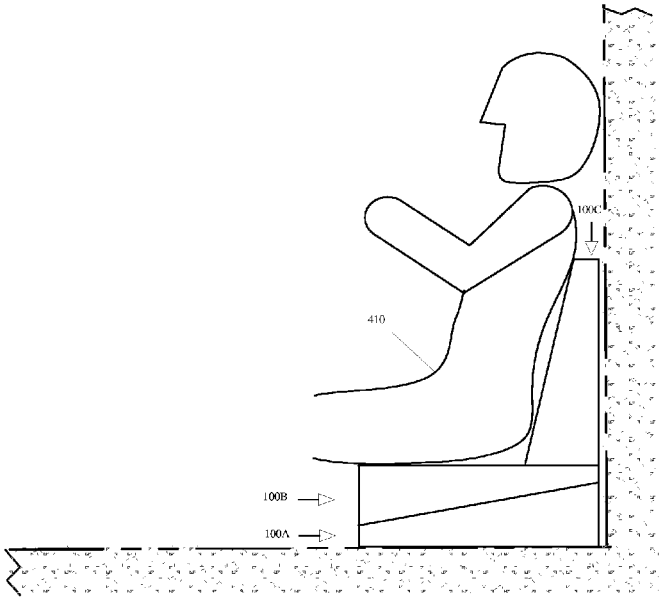
FIG. 9 schematically depicts the use of three identical support cushions to support a person in a sitting position.

Another alternate embodiment utilizing three identical support cushions is shown on FIG. 9, wherein the valise-like arrangement of support cushions 100A and 100B is used to support a sitting person and the third support cushion 100C is used to provide a backrest.

Yet another embodiment comprising three or more identical support cushions in a train-like arrangement to form a longer platform which may extend over additional staircase-like surfaces can be formed by attaching the support cushions next to each other as was shown for the two identical support cushions in the preferred embodiment.

Figure 10:
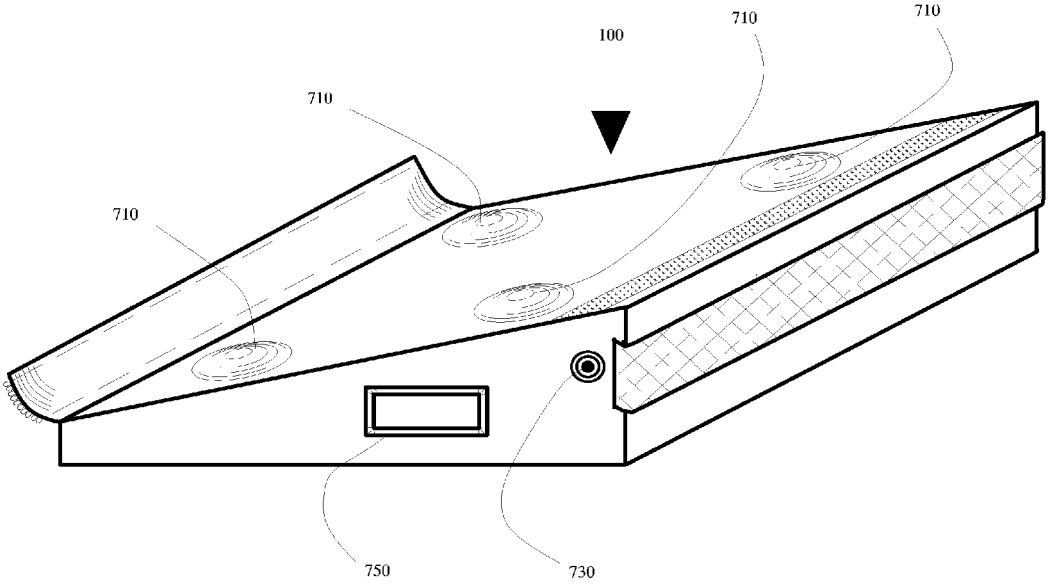
FIG. 10 is a perspective view of a support cushion with four lamps, a battery compartment and a switch.
Figure 11:
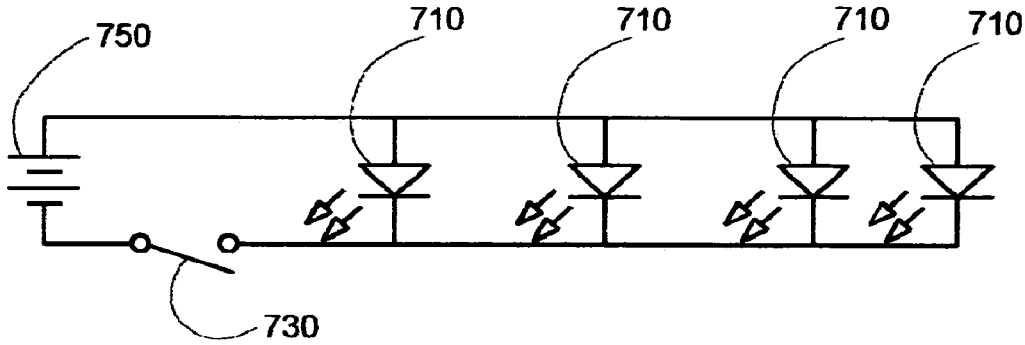
FIG. 11 is the electrical schematic of a circuit of four-lamps with a single switch and a single battery.

Referring to FIG. 10 an embodiment of the support cushion with illuminating means is described. Embedded in the top surface of the support cushion 100 are four lamps 710, located approximately in the vicinity of the corners of the top surface of the support cushion 100. The lamps 710 produce preferably a light beam with an angle of distribution between 10 and 60 degrees, and the lamps are so positioned in the support cushion that an imaginary axis perpendicular to the lamp through the center of the lamp will be tilted toward the approximate center of the support cushion at an angle of preferably between 5 and 20 degrees with an imaginary line perpendicular to the top surface of the support cushion 100 thus dispersing the illumination in the space over the person's head therefore minimizing the creation of shadows by the plumber's hands and other obstructions typically found in a sink cabinet. The lamps are preferably of a low-temperature LED type, wherein each lamp is selected from a range of lamps capable of producing a light output in the range of 1 to 5 Lumens at an luminous intensity of 10 to 50 Candelas while powered by preferably a direct current battery at a voltage of 9 V or less and a power consumption of not more than 0.5 Watts. The battery is stored in an accessible compartment 750 embedded in the support cushion and accessed on the side surface. The on-off control of the lamps is provided by a switch 730 embedded in the support cushion and accessed on the side surface. The electrical schematic of the arrangement of the four lamps 710, and the switch 730, and battery 750 is shown on FIG. 11. Two-lamp and six-lamp embodiments may be preferred in some situations. The number of lamps and characteristics of the lamps will vary with the environment in which the invention will be used.

Changes, variations and modifications to the basic design described in the preferred embodiments may be made without departing from the novel concepts in this invention. Additionally, these changes, variations and modifications may be obvious to those skilled in the art having the benefit of the teachings in this invention. All such changes, variations and modifications are intended to be within the scope of this invention.

What is claimed is:

1. A support cushion to provide ergonomic support for a person having to work in a supine position while extended over uneven vertically separated surfaces, the support cushion comprising two complementary cushions structured to provide an offset between respective horizontal base surfaces and substantially coplanar respective sloping top surfaces, wherein each complementary cushion further comprises a six-sided generally wedge shaped polyhedron comprising:

a) a shape defining core of lightweight resilient material comprising:
  i) the horizontal base surface being a substantially rectangular shape having parallel relatively longer edges and parallel relatively shorter edges;
  ii) a vertical rectangular front surface, having parallel vertical edges and a lower horizontal edge and an upper horizontal edge;
  iii) a vertical rectangular back surface, having parallel vertical edges and a lower horizontal edge and an upper horizontal edge; and
  iv) two vertical trapezoidal side surfaces, identical to each other, each having a horizontal bottom edge and a vertical front edge and a vertical back edge and sloping top edges, wherein:
    1) the horizontal bottom edge is common with one of the parallel longer edges of the horizontal rectangular base surface;
    2) the vertical front edge is common with one of the vertical edges of the vertical rectangular front surface;
    3) the vertical back edge is common with one of the vertical edges of the vertical rectangular back surface; and
    4) the sloping top edge connects the vertical front edge and the vertical back edge of the vertical trapezoidal side surface;
  v) the sloping top surface being a substantially rectangular shape having a front edge and a back edge and two parallel side edges, wherein:
    1) the front edge is common with the horizontal upper edge of the vertical rectangular front surface;
    2) the back edge is common with the horizontal upper edge of the vertical rectangular back surface; and
    3) each of the parallel side edges is common with the sloping top edge of one of the vertical trapezoidal side surfaces;

b) a rugged, waterproof, rot, and mildew resistant woven fabric cover shaped to closely conform to the core;

c) a flexible non-permanent fastening means composed of a two part ribbon hook and loop type fastener, wherein:
  i) a first ribbon containing a first complemental part of the hook and loop type fastener is attached to the support cushion cover on a sloping top rectangular surface thereof closely conforming to the sloping top rectangular surface of the support cushion core, wherein the ribbon is parallel with and near an edge of the support cushion cover created by the sloping top rectangular surface thereof with a back rectangular surface thereof closely conforming to the back rectangular surface of the support cushion core;
  ii) a strip of the cover fabric is limply attached to the edge of the support cushion cover created by the sloping top surface of the support cushion cover with a front surface thereof closely conforming to the front surface of the support cushion core; and iii) a second ribbon containing a second complemental part of the hook and loop type fastener is attached to the strip of cover fabric limply attached to the support cushion cover;

d) a carrying strap composed of polypropylene webbing attached to the support cushion cover at the vertical edges of the back rectangular surface, wherein the length of the strap is slightly longer than the longer edge of the back rectangular surface to provide space for a hand of a person between the back surface of the support cushion and the strap; and e) both the offset between respective horizontal base surfaces and the substantially coplanar respective sloping top surfaces of the two complementary cushions being structured by the first ribbon containing the first complemental part of the hook and loop type fastener that is attached to the support cushion cover of a first of the two complementary cushions on a sloping top rectangular surface thereof and positioned parallel with and near the edge of the support cushion cover created by the sloping top rectangular surface thereof with the back rectangular surface thereof being non-permanently joined with the second ribbon containing the second complemental part of the hook and loop type fastener that is attached to the strip of cover fabric that is limply attached to the edge of the support cushion cover of a second of the two complementary cushions created by the sloping top surface of the support cushion cover with the front surface thereof.

2. The support cushion of claim 1, further comprising:

a) a plurality of lamp housing compartments along the longer edges of the sloping rectangular top surface, at least two lamp housing compartments located near the vertices formed by the parallel side edges of the sloping rectangular top surface with the front edge of the sloping rectangular top surface, each compartment housing a lamp;

b) a battery housing compartment, housing a battery, wherein the battery is accessibly located through a vertical trapezoidal side surface;

c) a switch mechanism housing compartment, housing a switch mechanism, wherein the switch mechanism is operably located on a vertical trapezoidal side surface near the vertex formed by the top edge of the vertical trapezoidal side surface with the vertical back edge of the vertical trapezoidal side surface.

3. The support cushion of claim 1, further comprising a plurality of compartments distributed along the longer edge of the sloping rectangular top surface, at least two lamp housing compartments located near the vertices formed by the parallel side edges of the sloping rectangular top surface with the front edge of the sloping rectangular top surface, each compartment housing a lamp assembly wherein each lamp assembly comprises a lamp, a battery, and a switch operably located near the surface of the vertical trapezoidal side surface.

* * * * *